US006246842B1

(12) United States Patent
McClure

(10) Patent No.: US 6,246,842 B1
(45) Date of Patent: Jun. 12, 2001

(54) FUSER CONTROL FOR LIMITING CURRENT DRAW IN AN ELECTROPHOTOGRAPHIC MACHINE

(75) Inventor: Gregory Hardin McClure, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/494,913

(22) Filed: Jan. 31, 2000

(51) Int. Cl.[7] ..... G03G 15/20

(52) U.S. Cl. ..... 399/33; 399/69; 219/216; 219/470

(58) Field of Search ..... 399/69, 70, 330, 399/331, 33; 219/216, 388, 264, 511, 469, 470

(56) References Cited

U.S. PATENT DOCUMENTS 5,051,780 * 9/1991 Stelter et al. .
5,325,164 * 6/1994 Tai et al. ..... 399/322
5,329,343 * 7/1994 Saito .
5,517,293 * 5/1996 Tonai et al. ..... 399/331
5,543,904 * 8/1996 Kato et al. .
5,978,618 * 11/1999 Yamamoto et al. ..... 399/69
6,173,131 * 1/2001 Kitamura et al. ..... 399/33

FOREIGN PATENT DOCUMENTS 59-033480 * 2/1984 (JP) .
59-111669 * 6/1984 (JP) .
62-157073 * 7/1987 (JP) .
09-311584 * 12/1997 (JP) .

* cited by examiner

*Primary Examiner*—Robert Beatty
(74) *Attorney, Agent, or Firm*—Taylor & Aust

(57) ABSTRACT

A fuser assembly and associated method for an electrophotographic machine heats a first fuser roll with a first heating device. A second heating device heats a second fuser roll. It is determined whether a first temperature of the first fuser roll is below a first target temperature. It is also determined whether a second temperature of the second fluser roll is below a second target temperature. If both the first temperature is below the first target temperature and the second temperature is below the second target temperature, the first heating device is operated during a first time period and operation of the second heating device is inhibited throughout the first time period.

21 Claims, 3 Drawing Sheets

FUSER CONTROL FOR LIMITING CURRENT DRAW IN AN ELECTROPHOTOGRAPHIC MACHINE

BACKGROUND OF THE INVENTION

1. Field of the Invention.

The present invention relates to an electrophotographic machine, and, more particularly, to a fuser assembly in an electrophotographic machine.

2. Description of the Related Art.

A fuser assembly is used in an electrophotographic machine to fuse previously applied toner onto a surface of a print medium, such as paper. The fuser assembly includes a fuser roll which presses the toner into the print medium. The fuser roll is heated internally by a heating element, such as a fuser lamp, disposed therein.

The increase in function and speed of electrophotographic printers has driven a continuing increase in the amount of current drawn from the wall outlet to power the printing operation. The wattage of the system power supply continues to increase as more functions and higher speeds are demanded. The higher speeds, expressed in pages per minute, have led to the use of higher wattage fuser lamps and the use of multiple lamps to facilitate the toner fusing operation at these higher print speeds.

A problem is that the combination of the current drawn by the power supply and the fuser lamps can now exceed the amount of current available from a standard 15 ampere, 120 volt wall outlet. The high current draw can result in nuisance tripping of the circuit breaker. It is known to avoid such nuisance tripping by specifying the use of a dedicated, high current outlet. A problem is that such dedicated high current outlets require installation by a qualified electrician, which is both costly and time consuming.

What is needed in the art is a way of preventing the fuser assembly of an electrophotographic machine from causing nuisance tripping of the circuit breaker without having to install a dedicated high current outlet.

SUMMARY OF THE INVENTION

The present invention provides a method and apparatus for preventing the combined load of a printing system power supply and multiple high wattage fuser lamps from exceeding the alternating current (AC) line current available from a standard 15 ampere, 120 volt wall outlet.

The invention comprises, in one form thereof, a method of operating a fuser assembly in an electrophotographic machine. A first heating device heats a first fuser roll. A second heating device heats a second fuser roll. It is determined whether a first temperature of the first fuser roll is below a first target temperature. It is also determined whether a second temperature of the second fuser roll is below a second target temperature. If both the first temperature is below the first target temperature and the second temperature is below the second target temperature, the first heating device is operated during a first time period and operation of the second heating device is inhibited throughout the first time period.

An advantage of the present invention is that both a primary fuser lamp and a back-up fuser lamp may be operated without exceeding the amount of current available from a standard 15 ampere, 120 volt wall outlet.

Another advantage is that installation of a dedicated high current outlet is not required.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate preferred embodiments of the invention, but such exemplifications are not to be construed as limiting the scope of the invention in any manner.

DETAILED DESCRIPTION OF THE INVENTION

Figure 1:
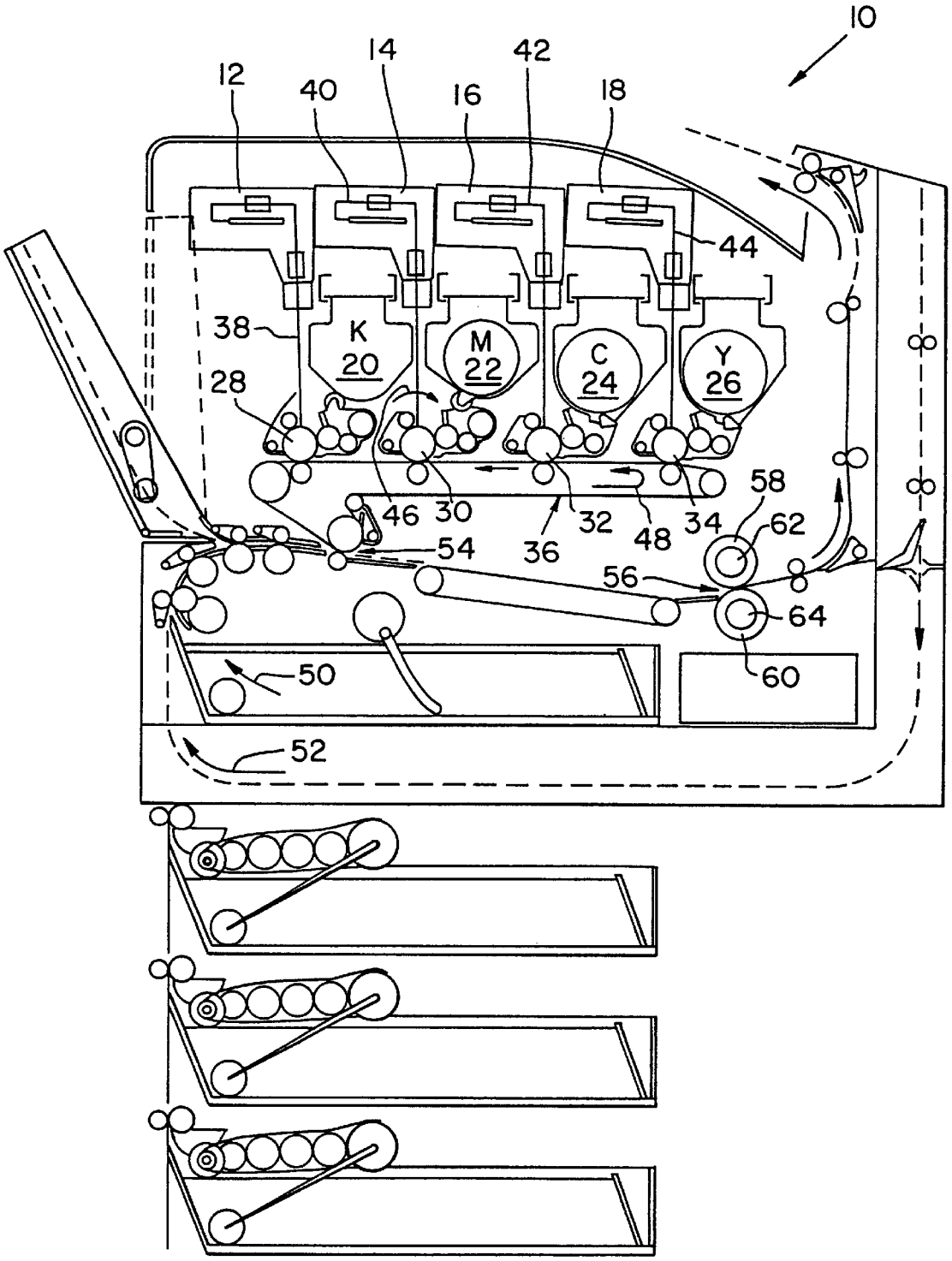
FIG. 1 is a side, sectional view of one embodiment of a multicolor laser printer in which the present invention may be used.

Referring now to the drawings and, more particularly, to FIG. 1, there is shown one embodiment of a multicolor laser printer 10 including laser print heads 12, 14, 16, 18. a black toner cartridge 20, a magenta toner cartridge 22, a cyan toner cartridge 24, a yellow toner cartridge 26, photoconductive drums 28, 30, 32, 34, and an intermediate transfer member belt 36.

Each of laser print heads 12, 14, 16 and 18 scans a respective laser beam 38, 40, 42, 44 in a scan direction, perpendicular to the plane of FIG. 1, across a respective one of photoconductive drums 28, 30, 32 and 34. Each of photoconductive drums 28, 30. 32 and 34 is negatively charged to approximately −900 volts and is subsequently discharged to a level of approximately −200 volts in the areas of its peripheral surface that are impinged by a respective one of laser beams 38, 40, 42 and 44. During each scan of a laser beam across a photoconductive drum, each of photoconductive drums At 28, 30, 32 and 34 is continuously rotated, clockwise in the embodiment shown, in a process direction indicated by direction arrow 46. The scanning of laser beams 38, 40, 42 and 44 across the peripheral surfaces of the photoconductive drums is cyclically repeated, thereby discharging the areas of the peripheral surfaces on which the laser beams impinge.

The toner in each of toner cartridges 20, 22, 24 and 26 is negatively charged to approximately −600 volts. Thus, when the toner from cartridges 20, 22, 24 and 26 is brought into contact with a respective one of photoconductive drums 28, 30, 32 and 34, the toner is attracted to and adheres to the portions of the peripheral surfaces of the drums that have been discharged to −200 volts by the laser beams. As belt 36 rotates in the direction indicated by arrow 48, the toner from each of drums 28, 30, 32 and 34 is transferred to the outside surface of belt 36. As a print medium, such as paper, travels along either path 50 or duplexing path 52, the toner is transferred to the surface of the print medium in nip 54.

After passing through nip 54, the print medium then passes through another nip 56 defined between a primary fuser roll 58 and a back-up fuser roll 60. As the print medium passes through nip 56, primary fuser roll 58 contacts the toner and presses it into the top side of the print medium. In order to improve the quality of this fusing process, primary fuser roll 58 and back-up fuser roll 60 are heated by a primary fuser lamp 62 and a back-up fuser lamp 64, respectively. Each of primary fuser roll 58 and back-up fuser roll 60 includes an internal cavity which receives a respective one of primary fuser lamp 62 and back-up fuser lamp 64.

Figure 2:
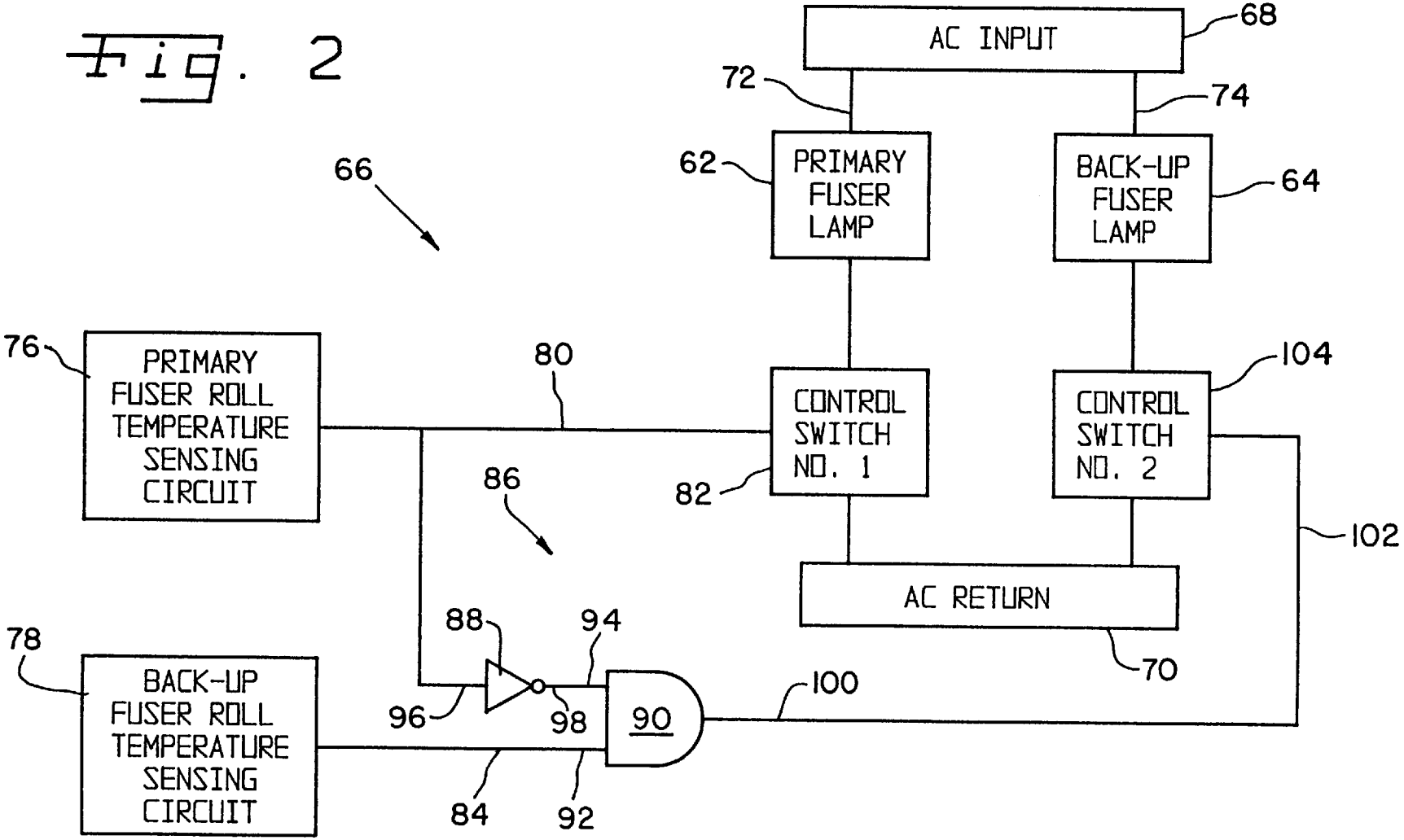
FIG. 2 is a schematic diagram of one embodiment of a fuser lamp control circuit of the present invention.

Each of primary fuser lamp 62 and back-up fuser lamp 64 is connected to a fuser lamp control circuit 66 (FIG. 2) which allocates the available current from an AC wall outlet having an input (hot) 68 and a return (neutral) 70 in such a way as to prevent the sum of the currents on current paths 72 and 74 from exceeding the rating of the outlet. This is accomplished by using a logic control circuit to allow only one of fuser lamps 62 and 64 to turn on at a given time. Further, lamps 62 and 64 are prioritized to insure that primary fuser lamp 62 receives power in the case where primary fuser roll temperature sensing circuit 76 and back-up fuser roll temperature sensing circuit 78 are attempting to turn on both lamps 62 and 64 at the same time.

Circuit 76 includes a sensor (not shown) for sensing the temperature of primary fuser roll 58. When the temperature of fuser roll 58 is below a predetermined target temperature, sensing circuit 78 generates and supplies a signal on signal path 80 to control switch 82. The signal on path 80 is a digital signal that has a signal level which is "high" when the temperature of primary fuser roll 58 is below the target temperature, and is "low" when the temperature of primary fuser roll 58 is at or above the target temperature. Upon receiving the "high" signal on path 80, control switch 82 closes, thereby applying power to primary fuser lamp 62. Conversely, when the signal on path 80 is "low," control switch 82 opens, thereby disconnecting power from primary fuser lamp 62.

Similarly to sensing circuit 76, back-up fuser roll temperature sensing circuit 78 includes a sensor (not shown) which senses the temperature of back-up fuser roll 60. When the temperature of back-up fuser roll 60 is below another predetermined target temperature, sensing circuit 78 generates and supplies a signal, on signal path 84, having a digital signal level which is "high." Conversely, when the temperature of back-up fuser roll 60 is at or above the second the target temperature, the signal on path 84 is "low."

A switch control circuit 86 includes an inverter 88 and an AND gate 90. One input 92 of AND gate 90 receives the digital signal supplied on signal path 84. The other input 94 of AND gate 90 receives an inverted version of the digital signal supplied on signal path 80 by sensing circuit 76. More particularly, an input 96 of inverter 88 receives the signal on path 80. An output 98 of inverter 88 then sends the inverted version of this signal to input 94 of AND gate 90. An output 100 of AND gate 90 supplies a digital signal on signal path 102 which is sent to a control switch 104.

If the temperature of primary fuser roll 58 is at or above the first target temperature, and the temperature of back-up fuser roll 60 is below the second target temperature, then a "high" signal is generated and sent to control switch 104 on signal path 102. Upon receiving this "high" signal, control switch 104 closes, thereby applying power to back-up fuser lamp 64. Under other conditions, the most important of which being when primary fuser roll 58 is below the first target temperature and power is being applied to primary fuser lamp 62, switch control circuit 86 prevents power from being applied to back-up fuser lamp 64. That is, switch control circuit 86 allows power to be applied to back-up fuser lamp 64 only when power is not being applied to primary fuser lamp 62. Even in this case, should the temperature of primary fuser roll 58 fall below the first target temperature, switch control circuit 86 will immediately shut off power from back-up fuser lamp 64 so that back-up fuser lamp 64 does not operate simultaneously with primary fuser lamp 62.

Figure 3:
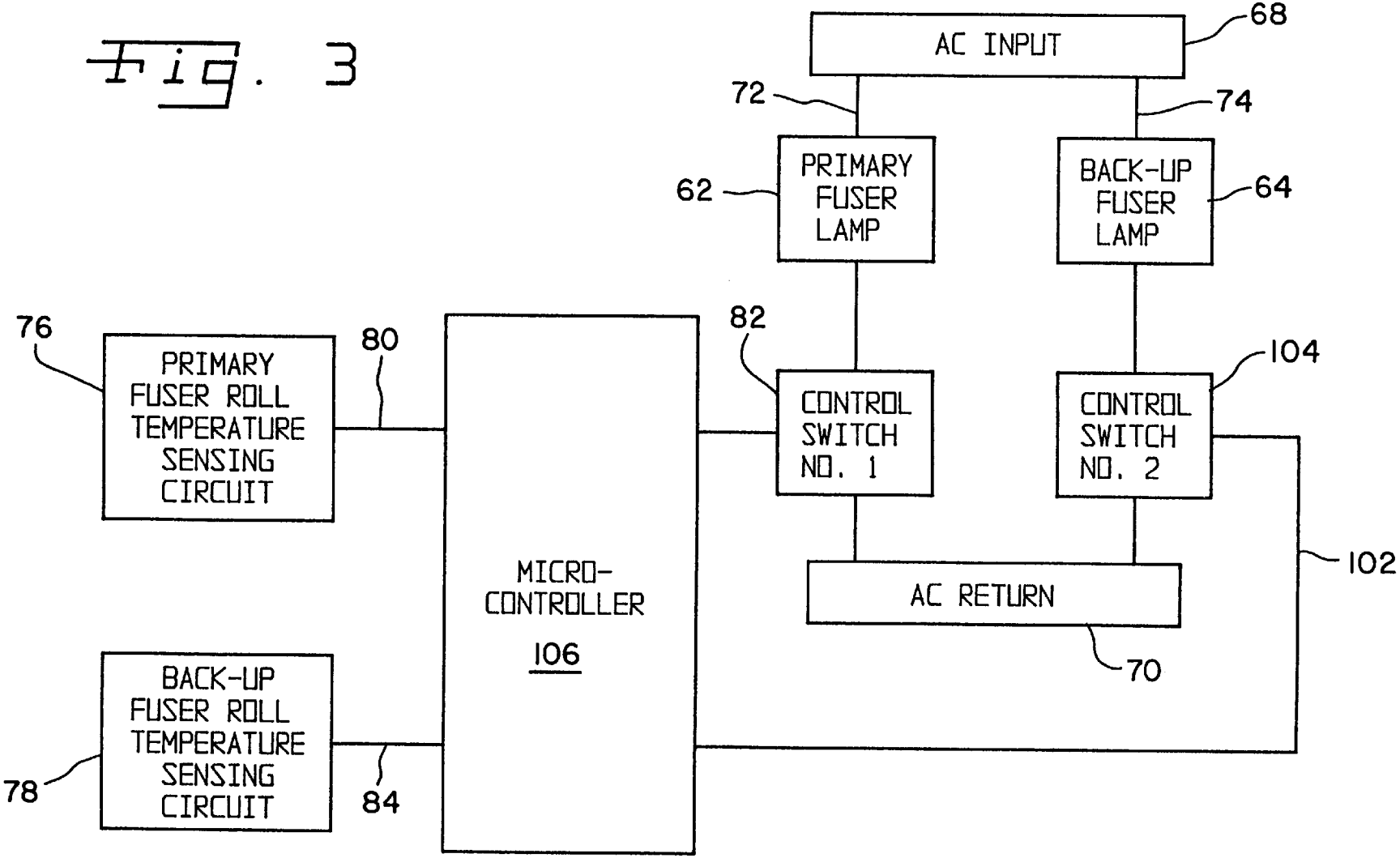
FIG. 3 is a schematic diagram of another embodiment of a fuser lamp control circuit of the present invention.

In another embodiment (FIG. 3) switch control circuit 86 is replaced by a microcontroller 106. Microcontroller 106 may pass unaltered the signal on path 80 to control switch 82. Alternatively, microcontroller 106 may delay one or both of the turn on times of control switch 82 and control switch 104 in order to place, for example, a gap of a few milliseconds between the turn off time of one of primary fuser lamp 62 and back-up fuser lamp 64 and the turn on time of the other. This further insures that current in not simultaneously drawn by primary fuser lamp 62 and back-up fuser lamp 64.

The present invention has been described herein in conjunction with fuser lamps. However, it is to be understood that the present invention can also be used with other types of heating elements, such as ceramic heating elements and resistive heating elements.

While this invention has been described as having a preferred design, the present invention can be further modified within the spirit and scope of this disclosure. This application is therefore intended to cover any variations, uses, or adaptions of the invention using its general principles. Further, this application is intended to cover such departures from the present disclosure as come within know or customary practice in the art to which this invention pertains and which falls within the limits of the appended claims.

What is claimed is:

1. A method of operating a fuser assembly in an electrophotographic machine, said method comprising the steps of:

providing a first fuser roll;

providing a first heating device configured for heating said first fuser roll;

providing a second fuser roll;

providing a second heating device configured for heating said second fuser roll;

determining whether a first temperature of said first fuser roll is below a first target temperature;

determining whether a second temperature of said second fuser roll is below a second target temperature; and if both said first temperature is below said first target temperature and said second temperature is below said second target temperature:

operating said first heating device until said first temperature is one of equal to and above said first target temperature; and inhibiting operation of said second heating device until said first temperature is one of equal to and above said first target temperature.

2. A method of operating a fuser assembly in an electrophotographic machine, said method comprising the steps of:

providing a first fuser roll;

providing a first heating device configured for heating said first fuser roll;

providing a second fuser roll;

providing a second heating device configured for heating said second fuser roll;

determining whether a first temperature of said first fuser roll is below a first target temperature;

determining whether a second temperature of said second fuser roll is below a second target temperature; and if both said first temperature is below said first target temperature and said second temperature is below said second target temperature:

operating said first heating device during a first time period; and inhibiting operation of said second heating device throughout said first time period;

wherein if said first target temperature is reached and said second target temperature is not reached, said method comprising the further steps of:

discontinuing said operation of said first heating device; and operating said second heating device after said discontinuing step.

3. A method of operating a fuser assembly in an electrophotographic machine, said method comprising the steps of:

providing a first fuser roll;

providing a first heating device configured for heating said first fuser roll;

providing a second fuser roll;

providing a second heating device configured for heating said second fuser roll;

determining whether a first temperature of said first fuser roll is below a first target temperature;

determining whether a second temperature of said second fuser roll is below a second target temperature; and if both said first temperature is below said first target temperature and said second temperature is below said second target temperature:

operating said first heating device during a first time period; and inhibiting operation of said second heating device throughout said first time period;

wherein if said first temperature falls below said first target temperature while said second heating device is in operation, said method comprising the further steps of:

discontinuing operation of said second heating device; and operating said first heating device after said discontinuing step.

4. The method of claim 1, wherein said first fuser roll comprises a primary fuser roll and said second fuser roll comprises a back-up fuser roll.

5. The method of claim 4, wherein said first heating device comprises a primary fuser lamp and said second heating device comprises a back-up fuser lamp.

6. The method of claim 5, wherein said primary fuser lamp is disposed within said primary fuser roll and said back-up fuser lamp is disposed within said back-up fuser roll.

7. A method, in an electrophotographic machine, of limiting a combined electrical current draw of a first heating device for heating a first fuser roll and a second heating device for heating a second fuser roll, said method comprising the steps of:

measuring a temperature of said first fuser roll; and inhibiting operation of said second heating device as long as said temperature of said first fuser roll is below a first target temperature.

8. A method, in an electrophotographic machine, of limiting a combined electrical current draw of a first heating device for heating a first fuser roll and a second heating device for heating a second fuser roll, said method comprising the steps of:

determining whether a first temperature of said first fuser roll is below a first target temperature;

generating a first signal having a signal level being dependent upon said determining step;

selectively operating said first heating device dependent upon said first signal; and selectively operating said second heating device dependent upon said first signal, wherein operation of said second heating device is inhibited if said first signal indicates that said first temperature of said first fuser roll is below said first target temperature.

9. A method, in an electrophotographic machine, of limiting a combined electrical current draw of a first heating device for heating a first fuser roll and a second heating device for heating a second fuser roll, said method comprising the steps of:

determining whether a first temperature of said first fuser roll is below a first target temperature;

generating a first signal having a signal level being dependent upon said determining step;

selectively operating said first heating device dependent upon said first signal;

selectively operating said second heating device dependent upon said first signal;

determining whether a second temperature of said second fuser roll is below a second target temperature;

generating a second signal having a signal level being dependent upon whether said second temperature of said second fuser roll is below said second target temperature; and selectively operating said second heating device dependent upon said second signal as well as said first signal.

10. The method of claim 9, wherein said second heating device is operated only if both said first signal indicates that said first temperature of said first fuser roll is above said first target temperature and said second signal indicates that said second temperature of said second fuser roll is below said second target temperature.

11. The method of claim 7, wherein said first fuser roll comprises a primary fuser roll, said second fuser roll comprising a back-up fuser roll.

12. The method of claim 11, wherein said first heating device comprises a primary fuser lamp disposed within said primary fuser roll, said second heating device comprising a back-up fuser lamp disposed within said back-up fuser roll.

13. A fuser assembly for an electrophotographic machine for applying toner onto a print medium, said fuser assembly comprising:

a primary fuser roll configured for causing the toner to be pressed onto the print medium;

a primary heating device configured for heating said primary fuser roll;

a first switching device connected to said primary heating device and configured for selectively applying power thereto;

a primary temperature sensing circuit coupled to said first switching device, said primary temperature sensing circuit being configured to:

sense a first temperature of said primary fuser roll;

compare said first temperature to a first target temperature; and generate a first signal to cause said first switching device to apply power to said primary heating device if said first temperature is below said first target temperature;

a back-up fuser roll configured for causing the toner to be pressed onto the print medium;

a back-up heating device configured for heating said back-up fuser roll;

a second switching device connected to said back-up heating device and configured for selectively applying power thereto;

a back-up temperature sensing circuit configured to:

sense a second temperature of said back-up fuser roll;

compare said second temperature to a second target temperature; and generate a second signal indicative of whether said second temperature is below said second target temperature;

a switch control circuit coupled to each of said primary temperature sensing circuit, said back-up temperature sensing circuit, and said second switching device, said control circuit being configured for receiving each of said first signal and said second signal and causing said second switching device to apply power to said back-up heating device only if:

said first temperature is one of equal to and above said first temperature; and said second temperature is below said second temperature.

14. The fuser assembly of claim 13, wherein a nip is defined between said primary fuser roll and said back-up fuser roll.

15. The fuser assembly of claim 14, wherein said nip is configured for receiving the print medium such that said primary fuser roll contacts a side of the print medium on which the toner is deposited, and said back-up roll contacts an opposite side of the print medium.

16. The fuser assembly of claim 15, wherein said primary heating device comprises a primary fuser lamp disposed within said primary fuser roll, said back-up heating device comprising a back-up fuser lamp disposed within said back-up fuser roll.

17. The fuser assembly of claim 16, wherein said control circuit comprises:

an inverter having an input and an output, said input receiving said first signal; and an AND gate having a first input, a second input and an output, said first input being connected to said output of said inverter, said second input receiving said second signal, said output of said AND gate being connected to said second switching device.

18. The fuser assembly of claim 13, wherein said control circuit comprises a microcontroller.

19. The fuser assembly of claim 13, wherein said control circuit limits a combined electrical current draw of said primary heating device and said back-up heating device.

20. The method of claim 1, comprising the further steps of:

stopping operation of said first heating device when said first temperature is one of equal to and above said first target temperature; and commencing operation of said second heating device when said first temperature is one of equal to and above said first target temperature.

21. A method of operating a fuser assembly in an electrophotographic machine, said method comprising the steps of:

providing a first fuser roll;

providing a first heating device configured for heating said first fuser roll;

providing a second fuser roll;

providing a second heating device configured for heating said second fuser roll; and inhibiting operation of said second heating device so long as a temperature of said first fuser roll is below a target temperature.

* * * * *